US012024854B2

(12) United States Patent
Vasicek et al.

(10) Patent No.: US 12,024,854 B2
(45) Date of Patent: Jul. 2, 2024

(54) EXCAVATOR BLADE CYLINDER

(71) Applicant: Clark Equipment Company, West Fargo, ND (US)

(72) Inventors: Bohuslav Vasicek, Prague (CZ); Martin Masa, Dobris (CZ)

(73) Assignee: Doosan Bobcat North America Inc., West Fargo, ND (US)

( * ) Notice: Subject to any disclaimer, the term of this patent is extended or adjusted under 35 U.S.C. 154(b) by 592 days.

(21) Appl. No.: 16/823,969

(22) Filed: Mar. 19, 2020

(65) Prior Publication Data

US 2020/0299926 A1 Sep. 24, 2020

Related U.S. Application Data

(60) Provisional application No. 62/820,447, filed on Mar. 19, 2019.

(51) Int. Cl.
*E02F 9/00* (2006.01)
*E02F 3/32* (2006.01)
(Continued)

(52) U.S. Cl.
CPC ..... *E02F 3/964* (2013.01); *E02F 3/325* (2013.01); *E02F 3/38* (2013.01); *E02F 9/0808* (2013.01); *E02F 9/121* (2013.01); *E02F 9/2271* (2013.01)

(58) Field of Classification Search
CPC ..... E02F 9/00; E02F 3/85; E02F 3/76; E02F 3/96; E02F 9/02; E02F 3/964;
(Continued)

(56) References Cited

U.S. PATENT DOCUMENTS 3,226,858 A * 1/1966 Spannhake ..... F15B 11/00 172/23
3,529,678 A * 9/1970 Teasdale ..... E02F 3/7613 172/739
(Continued)

FOREIGN PATENT DOCUMENTS

CN 101787719 A 7/2010
CN 107074298 A 8/2017
(Continued)

OTHER PUBLICATIONS

Notification of Transmittal of the International Search Report and the Written Opinion of the International Searching Authority, or the Declaration (including the International Search Report and Written Opinion) for International Application No. PCT/US2020/023593, dated Jul. 8, 2020, 14 pages.
(Continued)

*Primary Examiner* — Edwin J Toledo-Duran
(74) *Attorney, Agent, or Firm* — John Veldhuis-Kroeze; Westman, Champlin & Koehler, P.A.

(57) ABSTRACT

Disclosed embodiments include power machines with a lower implement pivotally coupled to an undercarriage frame by a lower lift arm structure and which include one or more cylinders or actuators that are operable to pivot the lower lift arm structure and lower implement relative to the undercarriage frame. A configuration of the one or more cylinders which mounts the cylinders behind the lower implement, with attachments to the undercarriage and to the lower lift arm structure at positions which allow the cylinders to be surrounded and protected by the undercarriage, reduces damage to the cylinders during operation.

15 Claims, 5 Drawing Sheets

(51) Int. Cl.

| | |
|---|---|
| ***E02F 3/38*** | (2006.01) |
| ***E02F 3/96*** | (2006.01) |
| ***E02F 9/08*** | (2006.01) |
| ***E02F 9/12*** | (2006.01) |
| ***E02F 9/22*** | (2006.01) |

(58) Field of Classification Search
CPC . E02F 3/325; E02F 3/38; E02F 9/0808; E02F 9/121; E02F 9/2271; E02F 3/7609
See application file for complete search history.

(56) References Cited

U.S. PATENT DOCUMENTS

| | | | | | |
|---|---|---|---|---|---|
| 3,631,931 | A * | 1/1972 | Frisbee | E02F 3/7613 | 172/484 |
| 3,759,110 | A * | 9/1973 | Davis | F16H 21/44 | 74/99 R |
| 3,913,684 | A * | 10/1975 | Casey | E02F 3/7613 | 172/307 |
| 4,081,036 | A * | 3/1978 | Yokoyama | E02F 3/7618 | 172/821 |
| 4,120,366 | A * | 10/1978 | Nissen | E02F 3/8157 | 172/817 |
| 4,215,496 | A | 8/1980 | Wehr | | |
| 4,244,429 | A * | 1/1981 | Nissen | E02F 3/7613 | 172/825 |
| 4,253,529 | A * | 3/1981 | Nissen | E02F 3/8157 | 172/818 |
| 4,270,617 | A * | 6/1981 | Cantarella | E02F 3/844 | 172/825 |
| 4,337,837 | A * | 7/1982 | Nissen | E02F 3/7613 | 172/825 |
| 4,364,439 | A | 12/1982 | Asal | | |
| 4,860,834 | A * | 8/1989 | Bidgood | E02F 3/96 | 414/723 |
| 4,962,816 | A * | 10/1990 | Imon | E02F 9/22 | 172/821 |
| 4,966,240 | A | 10/1990 | Aikawa | | |
| 5,010,961 | A | 4/1991 | Frisbee | | |
| 5,036,607 | A | 8/1991 | Taylor | | |
| 5,058,685 | A * | 10/1991 | Moffitt | E02F 3/7613 | 37/234 |
| 5,240,085 | A * | 8/1993 | Klossner | B60K 25/06 | 15/82 |
| 6,105,682 | A * | 8/2000 | Recker | E02F 3/7618 | 172/811 |
| 6,804,903 | B1 | 10/2004 | Cooper | | |
| 6,827,155 | B1 * | 12/2004 | Hoffart | A01B 59/044 | 172/824 |
| 7,013,983 | B2 * | 3/2006 | Matsumoto | E02F 3/7613 | 172/811 |
| 7,083,002 | B2 * | 8/2006 | Matsumoto | E02F 3/7613 | 172/822 |
| 7,320,380 | B2 | 1/2008 | Ueda et al. | | |
| 8,024,875 | B2 | 9/2011 | Wetzel et al. | | |
| 8,555,996 | B2 * | 10/2013 | Martinsson | E02F 3/38 | 172/816 |
| 8,678,103 | B2 | 3/2014 | Miyuki et al. | | |
| 9,915,055 | B2 | 3/2018 | Vanek et al. | | |
| 10,814,924 | B2 | 10/2020 | Haugen | | |
| 11,105,058 | B2 * | 8/2021 | Holzapfel | E01H 4/02 | |
| 2004/0060747 | A1 | 4/2004 | Wetzel et al. | | |
| 2004/0221490 | A1 | 11/2004 | Cooper et al. | | |
| 2014/0317967 | A1 | 10/2014 | Parker et al. | | |
| 2016/0121947 | A1 | 5/2016 | Lyle et al. | | |
| 2016/0122973 | A1 | 5/2016 | Lyle et al. | | |
| 2016/0122975 | A1 | 5/2016 | Vanek et al. | | |
| 2016/0122978 | A1 | 5/2016 | Matúsu et al. | | |
| 2017/0274947 | A1 | 9/2017 | Haugen | | |

FOREIGN PATENT DOCUMENTS

| | | | |
|---|---|---|---|
| CN | 108884664 | A | 11/2018 |
| JP | H09-111805 | A | 4/1997 |
| JP | 2001-260939 | A | 9/2001 |
| KR | 10-2010-0087616 | A | 8/2010 |

OTHER PUBLICATIONS

First Office Action, including search, for Chinese Patent Application No. 202080021875.3, dated Sep. 21, 2022, 17 pages.
Second Office Action for Chinese Patent Application No. 202080021875.3, dated Jun. 1, 2023, 13 pages.

* cited by examiner

EXCAVATOR BLADE CYLINDER

CROSS-REFERENCE TO RELATED APPLICATION

This application claims the benefit of U.S. Provisional Application No. 62/820,447, which was filed on Mar. 19, 2019.

BACKGROUND

This disclosure is directed toward power machines. More particularly, this disclosure is directed toward power machines, such as excavators, which have a blade implement coupled to an undercarriage frame.

Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, and trenchers, to name a few examples.

In excavators, a first lift arm structure is coupled to a house or upper frame which rotates relative to an undercarriage or lower frame. The first lift arm structure, typically a boom-arm lift arm structure, is configured to have a bucket or other implement attached for performing a work function such as digging. In some excavators, a second lift arm structure is coupled to the undercarriage frame to raise and lower a blade implement coupled to the second lift arm structure. Typically, these types of lift arm structures have one or more cylinders that are operable to pivot the lift arm structure and attached blade relative to the undercarriage frame. The cylinders can be exposed during operation of the excavator to debris and other material that can damage the cylinders.

The discussion above is merely provided for general background information and is not intended to be used as an aid in determining the scope of the claimed subject matter.

SUMMARY

Disclosed embodiments include power machines with an implement pivotally coupled to an undercarriage frame by a lift arm structure and which include one or more cylinders that are operable to pivot the lift arm structure and implement relative to the undercarriage frame. A configuration of the one or more cylinders which mounts the cylinders behind the lift arm structure and implement, with attachments to the undercarriage and to the lift arm structure at positions which allow the cylinders to be surrounded and protected by the undercarriage, reduces damage to the cylinders during operation.

One general aspect of some disclosed embodiments includes a power machine (100; 200; 400; 500) including: a frame (110; 210; 410; 510) including an undercarriage (212; 412; 512); first and second tractive elements (240A; 240B; 440A; 440B; 540A; 540B) coupled to left and right sides of the undercarriage; a lift arm structure (430; 530) pivotally coupled to the undercarriage at a lift arm pivot (436; 536); a first lift actuator (432-1; 432-2; 532) pivotally coupled to the undercarriage at a first pivot (432A; 532A) and pivotally coupled to the lift arm structure at a second pivot (432B; 532B), where the first and second pivots are positioned such that the first lift actuator is substantially surrounded by the undercarriage for protection.

Implementations may include one or more of the following features. The power machine where the second pivot (432B; 532B) is positioned below the lift arm pivot (436; 536). The power machine where the second pivot (432B; 532B) is positioned forward of the lift arm pivot (436; 536). The power machine where the first pivot (432A; 532A) is positioned rearward of a forward most position of the undercarriage such that, when the first lift actuator is fully extended, at least fifty percent of the length of first lift actuator is positioned rearward of the forward most position of the undercarriage. The power machine where the first pivot (432A; 532A) and second pivot (432B; 532B) are positioned such that, when the first lift actuator is fully extended, substantially all of the first lift actuator is positioned rearward of the forward most position of the undercarriage.

The power machine where the lift arm structure includes a first arm (430-1; 530-1) and a second arm (430-2; 530-2), where the lift arm pivot (436) is a co-linear lift arm pivot pivotally coupling both of the first arm and the second arm to the undercarriage. The power machine and further including a second lift actuator (432-2) pivotally coupled to the undercarriage and pivotally coupled to the lift arm structure, where the first pivot (432A) is a first co-linear pivot pivotally coupling both of the first and second lift actuators (432-1; 432-2) to the undercarriage, and where the second pivot (432B) is a second co-linear pivot pivotally coupling both of the first and second lift actuators to the lift arm structure. The power machine where the lift arm structure includes a cross-member (550) extending between the first lift arm (530-1) and the second lift arm (530-2), and where the second pivot (532B) is coupled to the cross-member.

The power machine and further including a blade implement (434; 534; 334) coupled to the lift arm structure. The power machine where the frame further including an upper frame portion (211) pivotally mounted to the undercarriage, the power machine further including an upper lift arm structure (230) pivotally coupled to the upper frame portion.

Another general aspect of some disclosed embodiments includes a power machine (100; 200; 400; 500) including: a frame (110; 210; 410; 510) including an undercarriage (212; 412; 512) and a house (211) rotatably coupled to the undercarriage; first and second tractive elements (240A; 240B; 440A; 440B; 540A; 540B) coupled to left and right sides of the undercarriage; an upper lift arm structure (230) pivotally coupled to the house; a lower lift arm structure (430; 530) pivotally coupled to the undercarriage at a lower lift arm pivot (436; 536); a first lift cylinder (432-1; 432-2; 532) pivotally coupled to the undercarriage at a first pivot (432A; 532A) and pivotally coupled to the lower lift arm structure at a second pivot (432B; 532B), where the first and second pivots are positioned such that at least fifty percent of the first lift cylinder is positioned rearward of a forward most position of the undercarriage when the first lift cylinder is fully extended.

Implementations may include one or more of the following features. The power machine where the second pivot (432B; 532B) is positioned below the lower lift arm pivot (436; 536). The power machine where the second pivot (432B; 532B) is positioned forward of the lower lift arm pivot (436; 536). The power machine where the first pivot (432A; 532A) and second pivot (432B; 532B) are positioned such that, when the first lift cylinder is fully extended, substantially all of the first lift cylinder is positioned rearward of the forward most position of the undercarriage.

The power machine where the lower lift arm structure includes a first arm (430-1; 530-1) and a second arm (430-2; 530-2), where the lower lift arm pivot (436) is a co-linear lift arm pivot pivotally coupling both of the first arm and the second arm to the undercarriage. The power machine and further including a second lift cylinder (432-2) pivotally coupled to the undercarriage and pivotally coupled to the lower lift arm structure, where the first pivot (432A) is a first co-linear pivot pivotally coupling both of the first and second lift cylinders (432-1; 432-2) to the undercarriage, and where the second pivot (432B) is a second co-linear pivot pivotally coupling both of the first and second lift cylinders to the lower lift arm structure. The power machine where the lower lift arm structure includes a cross-member (550) extending between the first lift arm (530-1) and the second lift arm (530-2), and where the second pivot (532*b*) is coupled to the cross-member.

The power machine and further including an implement (434; 534; 334) coupled to the lower lift arm structure.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed embodiments include power machines with a lower implement, such as a blade, pivotally coupled to an undercarriage frame by a lower lift arm structure with one or more cylinders that are operable to pivot the lower lift arm structure and lower implement relative to the undercarriage frame. Conventionally, in power machines such as excavators, these cylinders have been mounted above the lower lift arm structure so that they are exposed during operation of the power machine to debris and other material that can damage the cylinders. Disclosed embodiments utilize an arrangement with cylinders that are mounted behind the lower implement and attached to the lower lift arm structure at positions which allow the cylinders to be surrounded and protected by the undercarriage.

Figure 2:
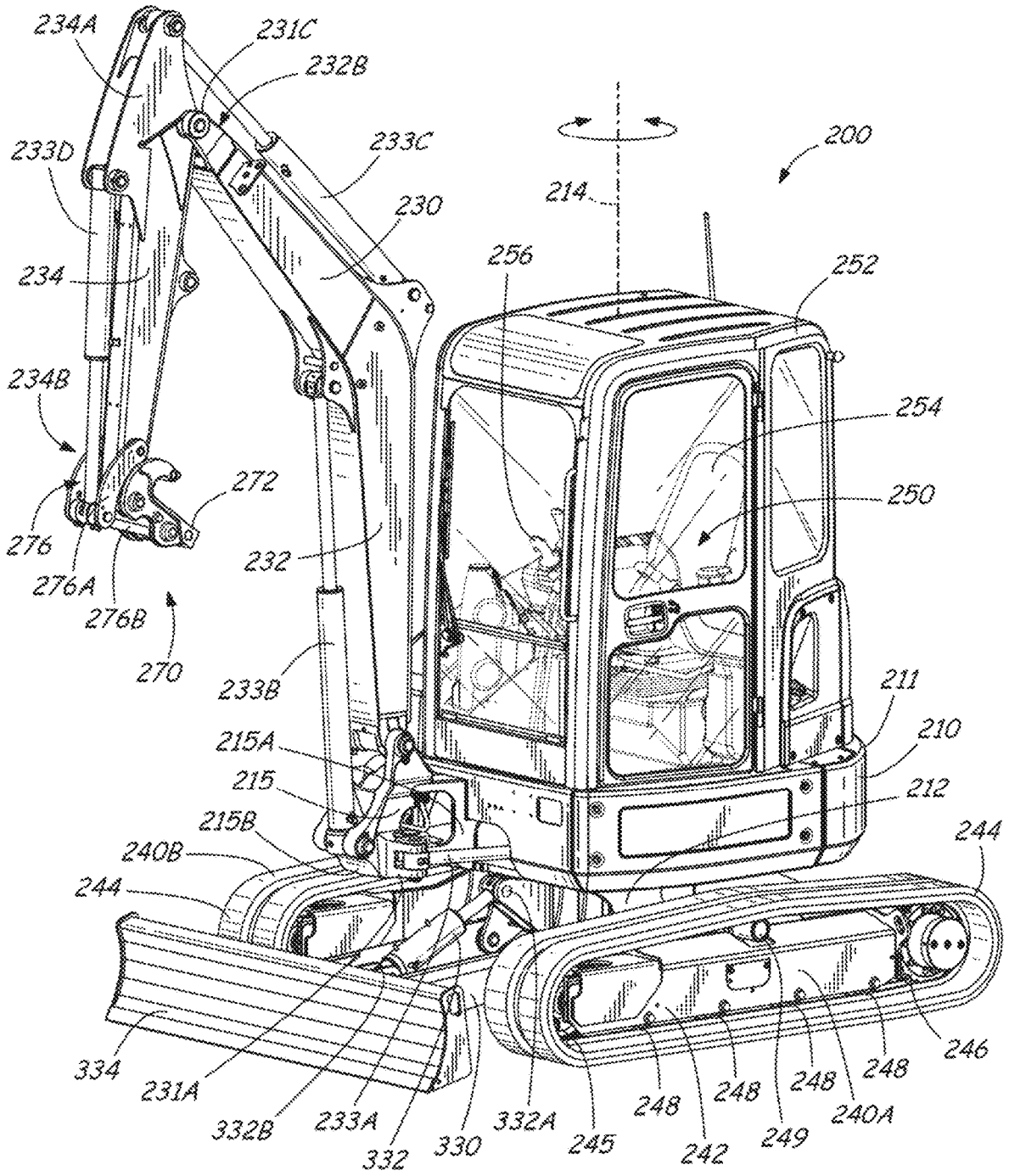
FIG. 2 is a front left perspective view of a representative power machine in the form of an excavator on which the disclosed embodiments can be practiced.
Figure 3:
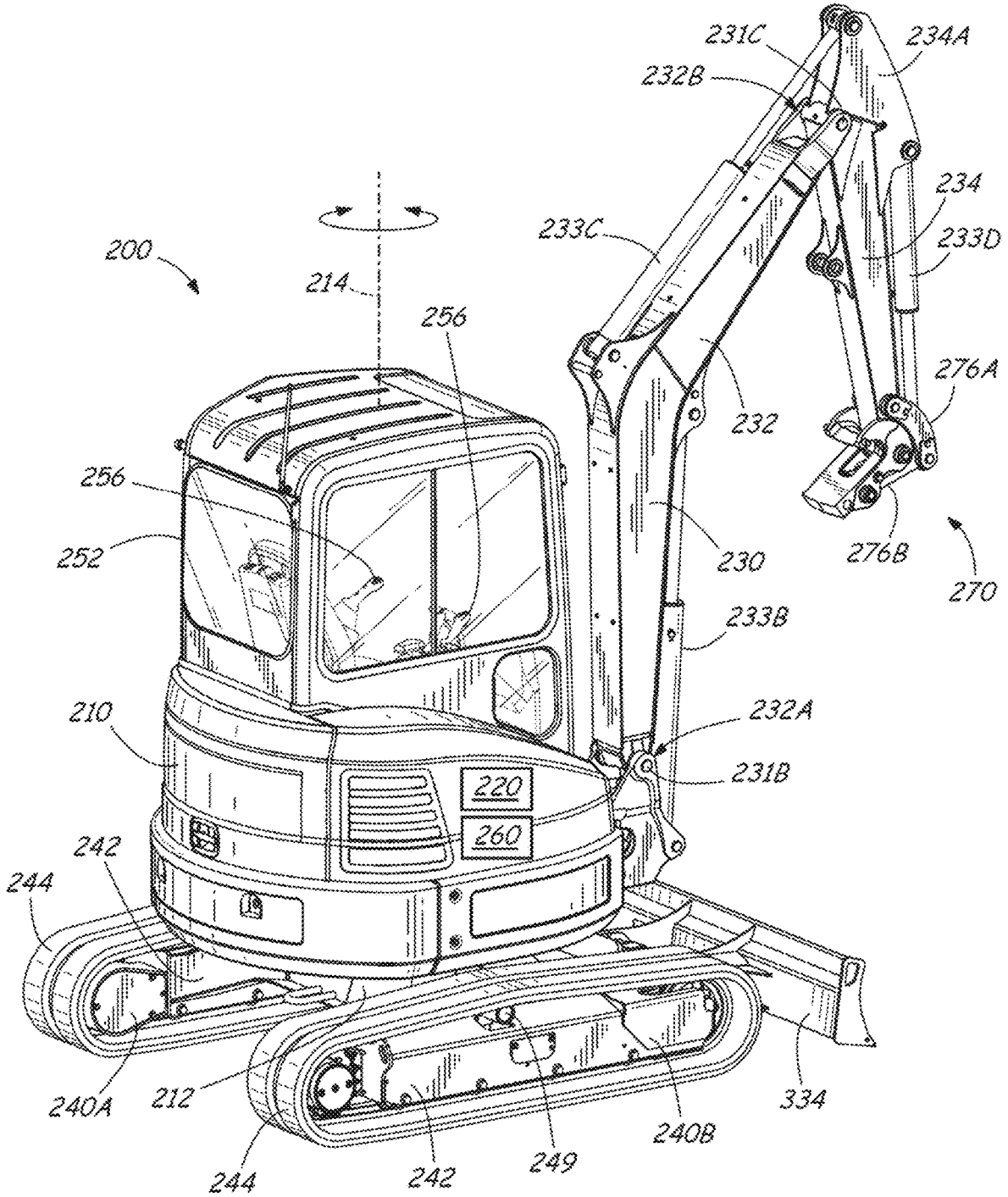
FIG. 3 is a rear right perspective view of the excavator of FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power. Disclosed embodiments can be utilized in different power machines and are particularly useful in power machines, such as excavators, where a house or upper frame rotates relative to an undercarriage or lower frame, and where a lower lift arm structure is coupled to the undercarriage frame to raise and lower a blade or other implement coupled to the lower lift arm structure. The lower lift arm structure can include an implement carrier to allow different implements to be attached thereto, or in the alternative, a blade or other implement can be formed with or permanently attached to the lower lift arm structure. In these different power machine embodiments, the cylinder or cylinders used to move the lower lift arm structure relative to the undercarriage are positioned in a configuration which allows the undercarriage to protect the cylinder or cylinders.

Figure 1:
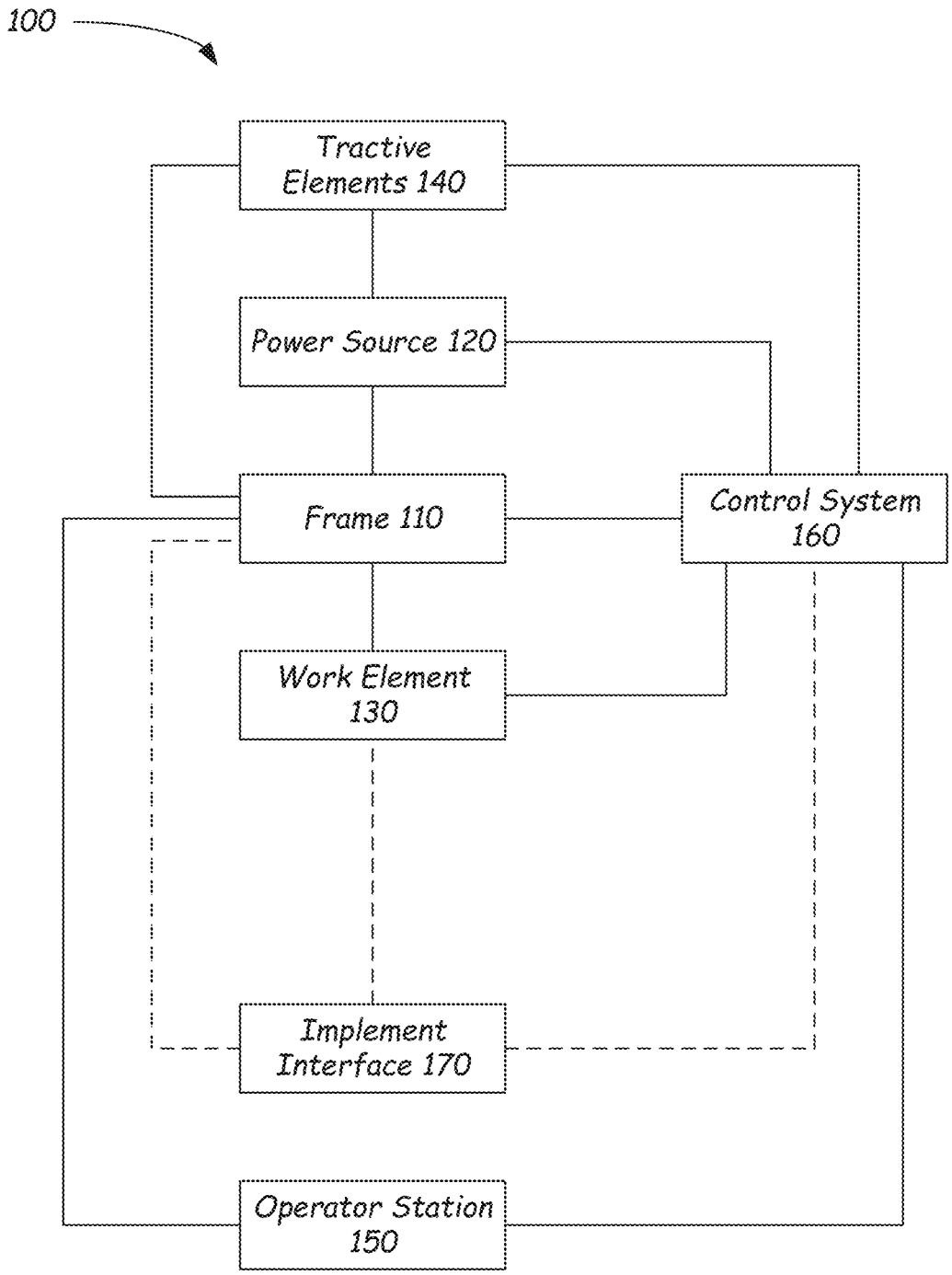
FIG. 1 is a block diagram illustrating functional systems of a representative power machine on which embodiments of the present disclosure can be practiced.

Referring now to FIG. 1, a block diagram illustrates the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that are capable of performing a dedicated task. For example, some work vehicles have a lift arm to which an implement such as a bucket is attached such as by a pinning arrangement. The work element, i.e., the lift arm can be manipulated to position the implement for the purpose of performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is capable of providing power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is capable of converting the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator controlled functions of the power machine can be operated from an operating position associated with an implement that is coupled to the power machine. Alternatively, with some power machines, a remote control device can be provided (i.e. remote from both of the power machine and any implement to which is it coupled) that is capable of controlling at least some of the operator controlled functions on the power machine.

FIGS. 2-3 illustrate an excavator 200, which is one particular example of a power machine of the type illustrated in FIG. 1, on which the disclosed embodiments can be employed. Unless specifically noted otherwise, embodiments disclosed below can be practiced on a variety of power machines, with the excavator 200 being only one of those power machines. Excavator 200 is described below for illustrative purposes. Not every excavator or power machine on which the illustrative embodiments can be practiced need have all of the features or be limited to the features that excavator 200 has. Excavator 200 has a frame 210 that supports and encloses a power system 220 (represented in FIGS. 2-3 as a block, as the actual power system is enclosed within the frame 210). The power system 220 includes an engine that provides a power output to a hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed A control system, shown as block 260 is provided for controlling the various work elements. Control system 260 includes operator input devices, which interact with the power system 220 to selectively provide power signals to actuators to control work functions on the excavator 200.

Frame 210 includes an upper frame portion or house 211 that is pivotally mounted on a lower frame portion or undercarriage 212 via a swivel joint. The swivel joint includes a bearing, a ring gear, and a slew motor with a pinion gear (not pictured) that engages the ring gear to swivel the machine. The slew motor receives a power signal from the control system 260 to rotate the house 211 with respect to the undercarriage 212. House 211 is capable of unlimited rotation about a swivel axis 214 under power with respect to the undercarriage 212 in response to manipulation of an input device by an operator. Hydraulic conduits are fed through the swivel joint via a hydraulic swivel to provide pressurized hydraulic fluid to the tractive elements and one or more work elements such as lift arm 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about an axis that extends longitudinally through the mounting frame pivot 231A.

The first lift arm structure 230 includes a first portion, known generally as a boom 232 and a second portion known as an arm or a dipper 234. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that is capable of accepting and securing a variety of different implements to the lift arm 230. Such implements have a machine interface that is configured to be engaged with the implement carrier 272. The implement carrier 272 is pivotally mounted to the second end 234B of the arm 234. An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown in FIGS. 2-3) available for connection to an implement on the lift arm structure 230. The implement power source includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The electrical power source can also include electrical conduits that are in communication with a data bus on the excavator 200 to allow communication between a controller on an implement and electronic devices on the excavator 200. It should be noted that the specific implement power source on excavator 200 does not include an electrical power source.

The lower frame 212 supports and has attached to it a pair of tractive elements 240, identified in FIGS. 2-3 as left track drive assembly 240A and right track drive assembly 240B. Each of the tractive elements 240 has a track frame 242 that is coupled to the lower frame 212. The track frame 242 supports and is surrounded by an endless track 244, which rotates under power to propel the excavator 200 over a support surface. Various elements are coupled to or otherwise supported by the track 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 is provided for providing tension on track 244 and prevent the track from rubbing on track frame 242.

A second, or lower lift arm 330 is pivotally attached to the lower frame 212. A lower lift arm actuator 332 is pivotally coupled to the lower frame 212 at a first end 332A and to the lower lift arm 330 at a second end 332B. The lower lift arm 330 is configured to carry a lower implement 334. The lower implement 334 can be rigidly fixed to the lower lift arm 330 such that it is integral to the lift arm. Alternatively, the lower implement can be pivotally attached to the lower lift arm via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm 330 to pivot with respect to the lower frame 212, thereby raising and lowering the lower implement 334.

Upper frame portion 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm 230, the lower lift arm 330, the traction system 240, pivoting the house 211, the tractive elements 240, and so forth.

Excavator 200 provides a variety of different operator input devices 256 to control various functions. For example, hydraulic joysticks are provided to control the lift arm 230, and swiveling of the house 211 of the excavator. Foot pedals with attached levers are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders and the like. The specific control examples provided above are exemplary in nature and not intended to describe the input devices for all excavators and what they control.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and excavator 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on an excavator such as excavator 200, unless otherwise noted, the concepts discussed below are not intended to be limited in their application to the environments specifically described above.

Figure 4:
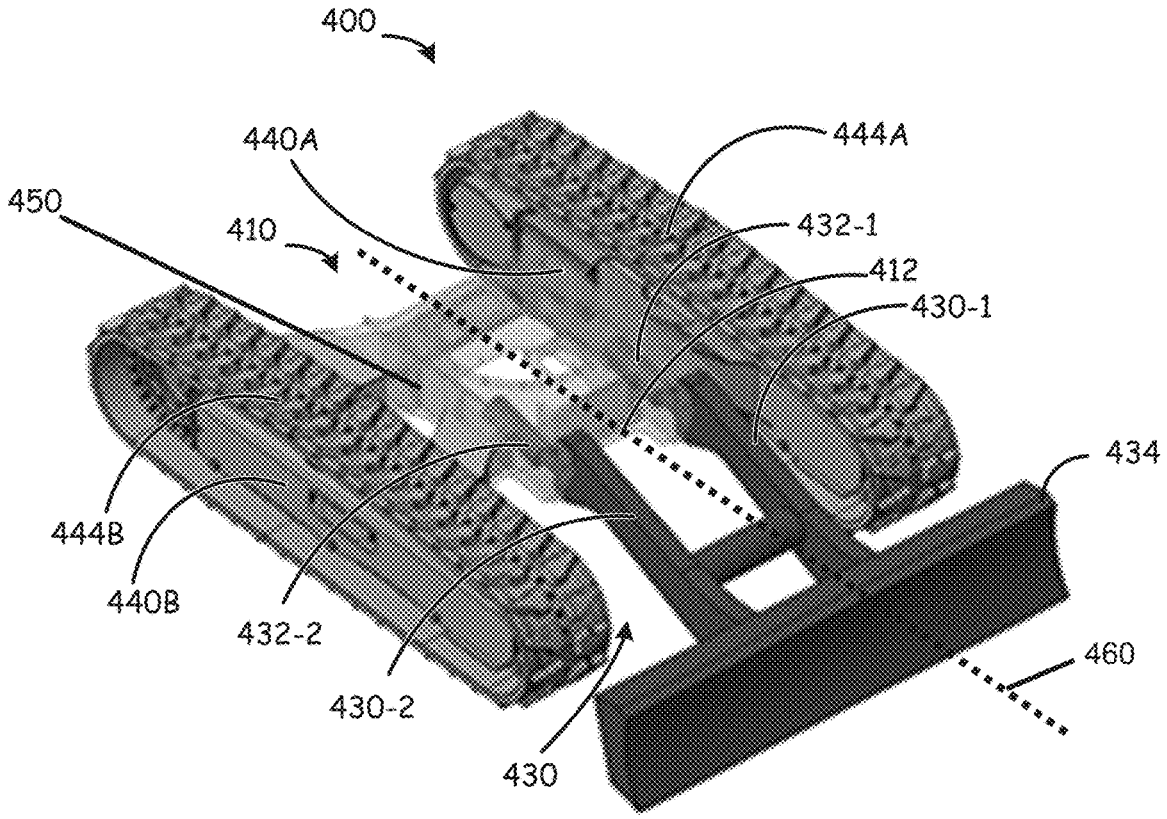
FIG. 4 is a perspective view of portions of a power machine including an undercarriage and showing a cylinder configuration between the undercarriage and a lower lift arm structure in accordance with an exemplary embodiment.
Figure 5:
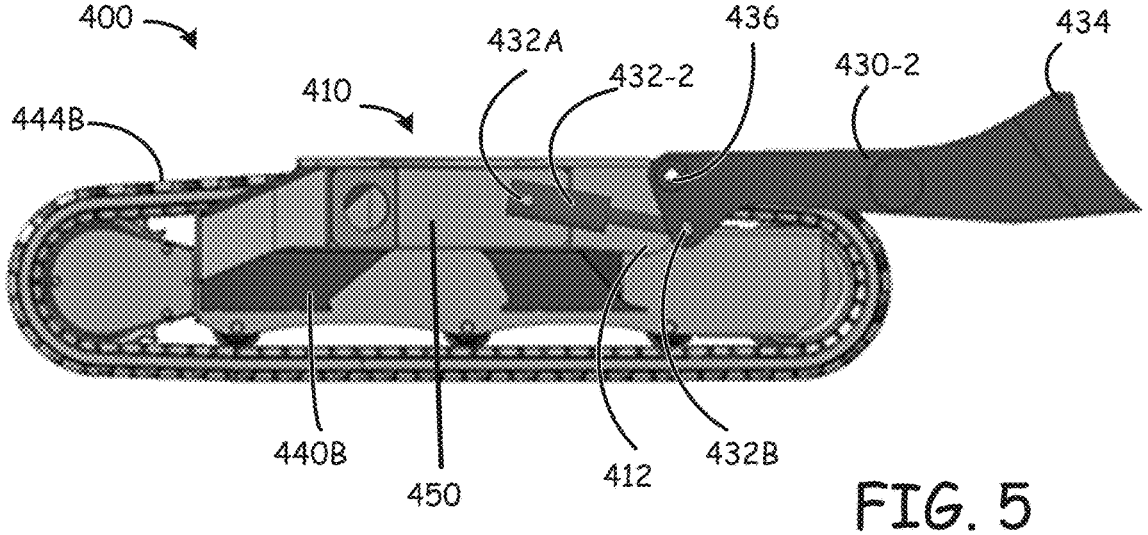
FIG. 5 is a cross-sectional side view of the portions of the power machine shown in FIG. 4.

Referring now to FIGS. 4 and 5, shown are portions of a power machine 400 which can be an embodiment of an excavator having some or all of the above-described features of power machine 100 and excavator 200. As can be seen in FIGS. 4 and 5, power machine 400 includes a frame 410 which has a lower frame portion or undercarriage 412. FIG. 4 is a perspective view of portions of the power machine including the undercarriage, while FIG. 5 is a cross-sectional view showing a portion of the undercarriage. An upper frame portion that is pivotally mounted on the undercarriage 412 is omitted to better illustrates features of exemplary embodiments. Power machine 400 also includes a pair of tractive elements in the form of left and right track assemblies 440A and 440B, which are disposed on opposing sides of the frame undercarriage 412 of frame 410. Endless tracks 444A and 444B are supported by the left and right track assemblies as was discussed with reference to FIGS. 2-3.

A lower or second lift arm structure 430, separate from the upper or first lift arm structure (not shown in FIGS. 4 and 5) coupled to the house, is pivotally coupled to the undercarriage 412 at one or more pivot connections 436. In one exemplary embodiment, lower lift arm structure 430 includes two separate arms 430-1 and 430-2 each pivotally coupled to the undercarriage 412, and therefore would include at least two co-linear pivot connections 436. However, this need not be the case in all embodiments. A blade or other lower implement 434 is either coupled to the lift arm structure 430 using an implement carrier which allows different implements to be removably mounted on the lift arm structure, or is integrally formed with or permanently attached to the lift arm structure. One or more actuators or cylinders 432 are pivotally coupled at a first end to undercarriage 412 and at a second end to lift arm structure 430 to cause the lift arm structure to rotate about pivot connections 436 to raise and lower the lift arm structure and implement 434. In the illustrated embodiment, two cylinders 432-1 and 432-2 are each coupled to corresponding ones of arms 430-1 and 430-2 to raise and lower the lift arm structure. For each cylinder, at a first end (e.g., the base end) the cylinder is pivotally coupled to the undercarriage at a pivot connection 432A, and at a second end (e.g., the rod end) the cylinder is pivotally coupled to the lift arm structure 430 at a pivot connection 432B. Although illustrated with one particular base end and rod end configuration, those of skill in the art will recognize that the opposite base and rod end configuration can alternatively be used.

In exemplary embodiments, cylinders 432-1 and 432-2 are mounted behind the lift arm structure 430 and blade implement 434, instead of above, and are attached with pivot connection 432B near an end of the lift arm structure. This allows the cylinders to be completely or substantially surrounded by the undercarriage for protection. In some exemplary embodiments, this is achieved by placing the pivot connection 432B between each cylinder and the lift arm structure 430 below the pivot connection 436 between the lift arm structure and the undercarriage 412. In the illustrated embodiment, the pivot connection 432B is also positioned forward of the pivot connection 436, but this need not be the case in all embodiments. The pivot connection 432A is mounted sufficiently inset into the undercarriage that, even when fully extended as shown, all or most of the cylinder remains inset into the undercarriage (rearward of the forward most position of the undercarriage). While a portion of the cylinder can extend beyond the forward most position of the undercarriage, in exemplary embodiments, at least 50 percent of the fully extended cylinder is rearward of the forward most portion of the undercarriage.

In some exemplary embodiments, the lift actuators or cylinders 432-1 and 432-2 are positioned on respective sides of a centerline axis 460 of the undercarriage. The undercarriage includes one or more frame members 450 extending in a forward to back direction substantially inline or parallel with the centerline axis 460 that also extends in the forward to back direction. In an exemplary embodiment, the undercarriage includes a pair of frame members 450, with one on either side of the centerline axis 460. Also in exemplary embodiments, the lift actuators or cylinders are each positioned between one of the frame members 450 and the centerline axis 460.

Figure 6:
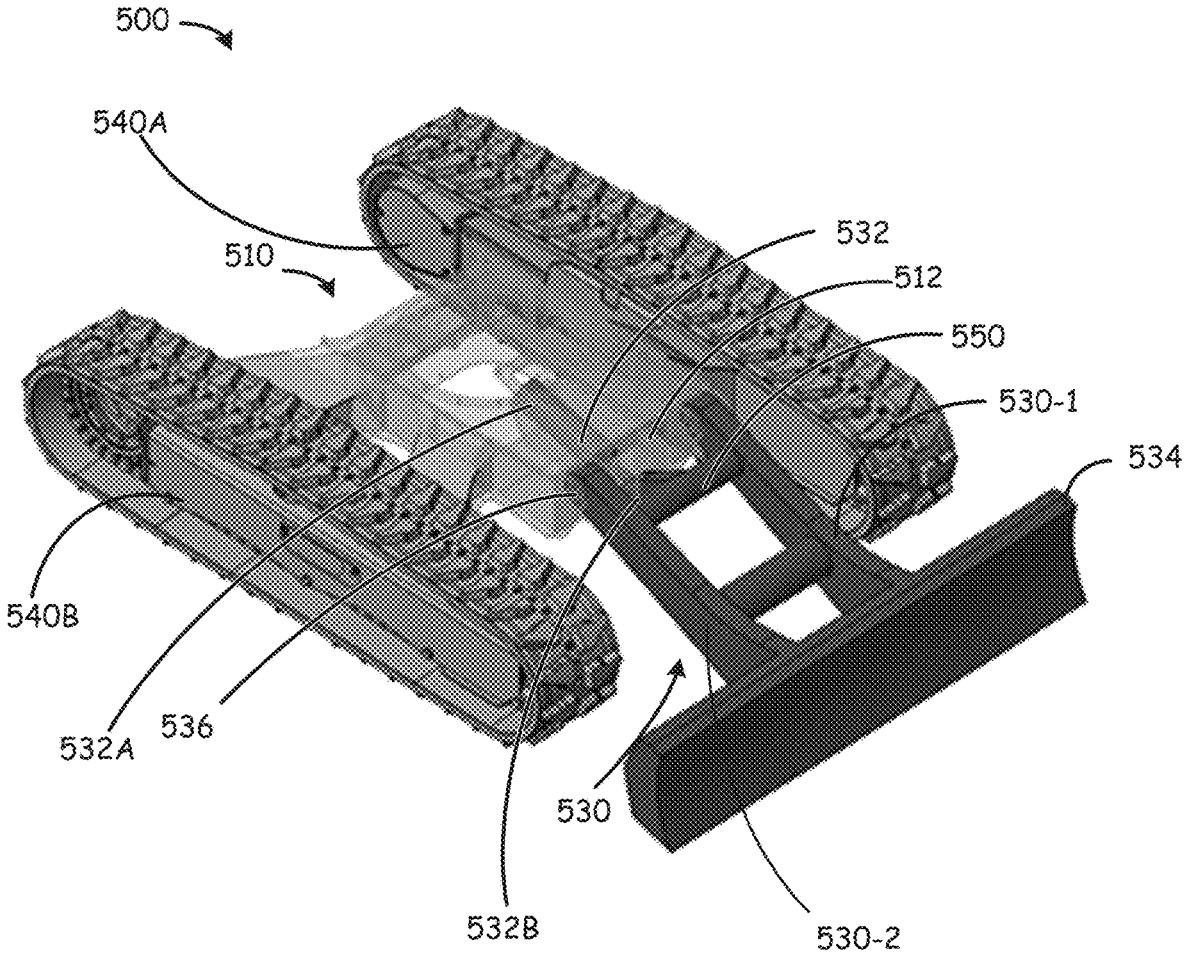
FIG. 6 is a perspective view of portions of a power machine including an undercarriage and showing a cylinder configuration between the undercarriage and a lower lift arm structure in accordance with another exemplary embodiment.

Referring now to FIG. 6, shown are portions of a power machine 500, which is substantially similar to power machine 400, but which includes a slightly different lift arm structure 530 allowing a single cylinder 532 to actuate the lift arm structure to raise and lower implement 534. As was the case with cylinders 432, cylinder 532 is positioned substantially or entirely within the structure of undercarriage 512. As illustrated, cylinder 532 is mounted behind a laterally central portion of the lift arm structure 530 and blade implement 534, instead of above, and is attached with pivot connection 532B coupled to a cross-member 550 of the lift arm structure. Pivot connection 532B is forward of pivot connections 536 between the lift arm structure 530 and the undercarriage 512, but pivot connection 532A between the other end of the cylinder and the undercarriage is again mounted sufficiently inset into the undercarriage that, even when fully extended, all or most of the cylinder 532 remains inset into the undercarriage (rearward of the forward most position of the undercarriage). In some exemplary embodiments, the pivot connection 532B is positioned above the lift arm pivot connections 536 to provide additional protection of the lift cylinder or actuator. Again, while a portion of the cylinder 532 can extend beyond the forward most position of the undercarriage 512 of frame 510, in exemplary embodiments, at least 50 percent of the fully extended cylinder is rearward of the forward most portion of the undercarriage. This provides improved protection of the cylinder 532 during operation of the power machine. Also, in various embodiments, while the cylinder side of actuators, such cylinders 432-1, 432-2 and 532, are shown attached to the undercarriage frame with the rod side attached to the lift arm structures, in other embodiments the rod side can be attached to the undercarriage frame and the cylinder side attached to the lift arm structures.

Although the present invention has been described with reference to preferred embodiments, workers skilled in the art will recognize that changes may be made in form and detail without departing from the scope of the discussion.

What is claimed is:

1. A power machine comprising:

a frame including an undercarriage;

first and second tractive elements coupled to left and right sides of the undercarriage, wherein a front of each tractive element is located forward of a front edge of the undercarriage;

a lift arm structure including one or more lift arms, each arm having a base end pivotally coupled to the undercarriage at a lift arm pivot connection that is located rearward of the front of each tractive, wherein each lift arm extends from the base end and forward of the front of each tractive element to an implement end; and one or more lift actuators pivotally and directly coupled to the undercarriage at a first pivot and pivotally and directly coupled to the lift arm structure at a second pivot and configured to lift and lower the lift arm structure including the one or more lift arms, wherein each first pivot is located rearward of the lift arm pivot connection for each arm and wherein each second pivot is positioned at the base end of each arm and below the lift arm pivot connection for each arm;

wherein the first and second pivots are positioned such that the one or more lift actuators are substantially surrounded by the undercarriage between a fully retracted and a fully extended position; and wherein the first pivot is positioned rearward of a forward most position of the undercarriage such that, when the one or more lift actuators are fully extended, substantially all of the one or more lift actuators are positioned rearward of the forward most position of the undercarriage.

2. The power machine of claim 1, wherein the lift arm structure includes a first arm and a second arm, wherein the lift arm pivot connection is a co-linear lift arm pivot connection pivotally coupling both of the first arm and the second arm to the undercarriage.

3. The power machine of claim 2, and further comprising a first lift actuator and a second lift actuator pivotally coupled to the undercarriage and pivotally coupled to the lift arm structure, wherein the first pivot of the first lift actuator and the second lift actuator are a first co-linear pivot pivotally coupling both of the first and second lift actuators to the undercarriage, and wherein the second pivot of the first lift actuator and the second lift actuator are a second co-linear pivot pivotally coupling both of the first and second lift actuators to the lift arm structure.

4. The power machine of claim 2, wherein the lift arm structure includes a cross-member extending between the first lift arm and the second lift arm.

5. The power machine of claim 1, and further comprising a blade implement coupled to the implement end of the lift arm structure.

6. The power machine of claim 5, wherein the frame further comprising an upper frame portion pivotally mounted to the undercarriage, the power machine further comprising an upper lift arm structure pivotally coupled to the upper frame portion.

7. The power machine of claim 1, wherein the undercarriage includes a frame member extending in a forward to back direction substantially inline with a centerline axis that extends in the forward to back direction and wherein the first lift actuator is positioned between the frame member and the centerline.

8. A power machine comprising:

a frame including an undercarriage and a house rotatably coupled to the undercarriage, wherein the house supports an operator compartment;

first and second tractive elements coupled to left and right sides of the undercarriage;

an upper lift arm structure pivotally coupled to the house;

a lower lift arm structure including a cross-member extending between a first lift arm and a second lift arm and pivotally coupled to the undercarriage at a lower lift arm pivot connection, wherein the lower lift arm structure is separate from and spaced apart from the upper lift arm structure; and a first lift cylinder pivotally and directly coupled to the undercarriage at a first pivot and pivotally and directly coupled to the lower lift arm structure at a second pivot and configured to lift and lower the lift arm structure including the first and second lift arms, wherein the first pivot is located rearward of the lift arm pivot connection and wherein the second pivot is coupled to the cross-member; and wherein the first and second pivots are positioned such that, when the first lift cylinder is fully extended, substantially all of the first lift cylinder is positioned rearward of the forward most position of the undercarriage.

9. The power machine of claim 8, wherein the lower lift arm pivot connection is a co-linear lift arm pivot pivotally coupling both of the first arm and the second arm to the undercarriage.

10. The power machine of claim 8, wherein the first and second pivots are positioned such that the one or more lift actuators are substantially surrounded by the undercarriage between a fully retracted and a fully extended position.

11. A power machine comprising:

a frame including an undercarriage;

first and second tractive elements coupled to left and right sides of the undercarriage;

a lift arm structure including one or more lift arms, each arm having a base end pivotally coupled to the undercarriage at a lift arm pivot connection, wherein each lift arm extends from the base end to an implement end; and one or more lift actuators pivotally and directly coupled to the undercarriage at a first pivot and pivotally and directly coupled to the lift arm structure at a second pivot and configured to lift and lower the lift arm structure including the one or more lift arms, wherein the first pivot is located rearward of the lift arm pivot connection of each lift arm and wherein the second pivot is positioned at the base end of each arm and below the lift arm pivot connection of each arm.

12. The power machine of claim 11, wherein the first and second pivots are positioned such that the one or more lift actuators are substantially surrounded by the undercarriage between a fully retracted and a fully extended position.

13. The power machine of claim 11, wherein the first pivot is positioned rearward of a forward most position of the undercarriage such that, when the one or more lift actuators are fully extended, substantially all of the one or more lift actuators are positioned rearward of the forward most position of the undercarriage.

14. The power machine of claim 11, wherein the lift arm structure includes a first arm and a second arm, wherein the lift arm pivot connection is a co-linear lift arm pivot connection pivotally coupling both of the first arm and the second arm to the undercarriage.

15. The power machine of claim 14, and further comprising a first lift actuator and a second lift actuator pivotally coupled to the undercarriage and pivotally coupled to the lift arm structure, wherein the first pivot of the first lift actuator and the second lift actuator are a first co-linear pivot pivotally coupling both of the first and second lift actuators to the undercarriage, and wherein the second pivot of the first lift actuator and the second lift actuator are a second co-linear pivot pivotally coupling both of the first and second lift actuators to the lift arm structure.

* * * * *